United States Patent [19]

Kelly

[11] Patent Number: 4,460,947

[45] Date of Patent: Jul. 17, 1984

[54] LIGHT FIXTURE HOUSING INCLUDING SNAP LATCH

[75] Inventor: James P. Kelly, Waterford, Wis.

[73] Assignee: McGraw-Edison, Rolling Meadows, Ill.

[21] Appl. No.: 482,799

[22] Filed: Apr. 7, 1983

[51] Int. Cl.[3] ..... F21V 17/00

[52] U.S. Cl. ..... 362/374; 362/294; 362/311; 362/362; 362/373; 362/375; 362/376

[58] Field of Search ..... 362/294, 311, 362, 373, 362/375, 376, 374

[56] References Cited

U.S. PATENT DOCUMENTS 3,943,355 3/1976 Lundy ..... 362/374

*Primary Examiner*—Stephen J. Lechert, Jr.

*Attorney, Agent, or Firm*—Charles W. MacKinnon; Jon Carl Gealow; John Paniaquas

[57] ABSTRACT

A light fixture housing includes upper and lower members. The upper member includes a top bounded on four sides by a wall and the lower member includes a bottom also bounded on four sides by a wall. The walls of the two members define four corners of the housing. At each of the corners in the upper member a tang with an inclined leading ramp is formed on the inner peripheral surface of the wall and is flanked at two sides by a guide. At each of the corners of the lower member and upstanding tongue extends above the wall and includes an aperture for receiving the tang when the upper and lower members are assembled. A slot is located in at least one of the corners of the upper member adjacent to the locking tang and a notch is formed in the upper end of at least one of the tongues such that a power line may be threaded through and held within the slot. To assemble the housing, the upper and lower members are positioned together and each of the tongues is positioned within a set of guides. The upper and lower members are locked together after each tang is positioned within an aperture and, after assembly, the latching mechanism is completely hidden from view.

15 Claims, 3 Drawing Figures

FIG. 1
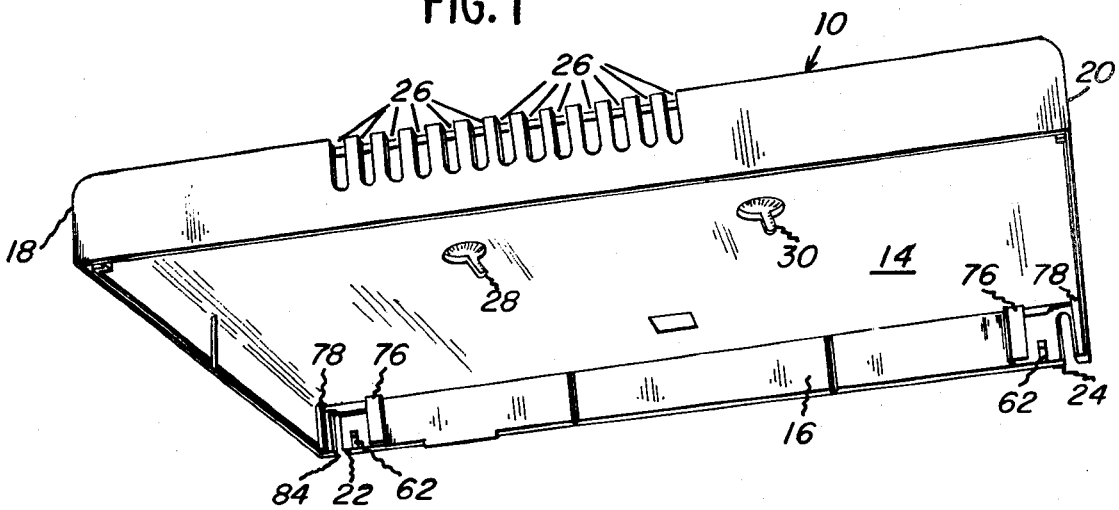
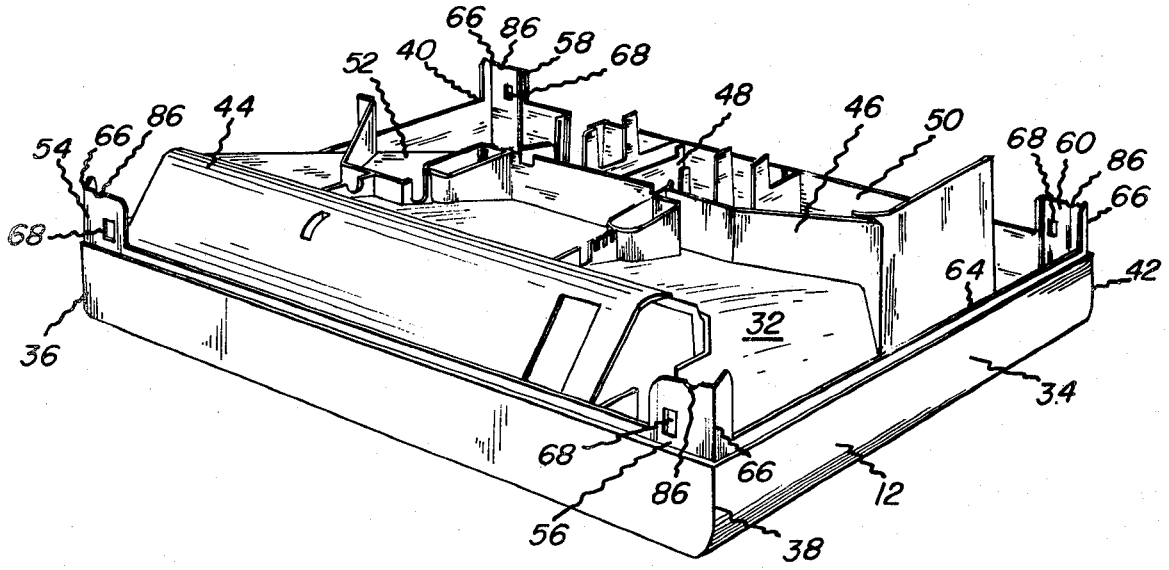
FIG. 2

LIGHT FIXTURE HOUSING INCLUDING SNAP LATCH

BACKGROUND OF THE INVENTION

The present invention relates to a new and improved light fixture housing including a hidden snap latch for latching upper and lower members of the housing.

It is often undesirable that repair or disassembly of light fixtures in certain environments such as office settings be attempted by a layperson. Unauthorized disassembly or tampering of lighting fixtures frequently occurs with lights that are easily accessible, for example, those employed for lighting task areas such as undershelf task lights used in areas not well lit by overhead lights. Many light fixtures of this type can be easily diassembled after a brief inspection of the housing since the means for gaining access, such as core holes or offsets, are visible. Therefore, it is desirable to provide a light fixture that may be used to supplement room lighting which includes a latch structure for effectively holding the parts of the fixture housing together which is not visible from the exterior. Such a latch structure, however, should occupy little interior space in the light fixture housing since most of the space is necessary for the light bulb and related components. It is also preferrable that the latch structure not be a separate piece since the additional time required for assembly of the separate piece increases assembly costs. For convenience and to reduce assembly time it is also desirable that the housing parts be assembled without th need for tools.

SUMMARY OF THE INVENTION

An object of the present invention is to provide a new and improved latch for a light fixture housing.

Another object of the present invention is to provide a new and improved light fixture housing employing a latch that is not visible upon inspection of the outer periphery of the housing.

A further object of the present invention is to provide a new and improved light fixture housing employing a latch which is not visible from the outside of the housing and which requires little internal space.

A still further object of the present invention is to provide a new and improved light fixture housing employing a latch that allows the housing to be assembled without the necessity of tools.

Briefly, the present invention is directed to a new and improved light fixture housing having a molded latch that is not visible upon inspection of the outer periphery of the assembled housing. The housing is defined by upper and lower housing members. The upper member includes a top bounded by a sidewall that defines one or more corners. The lower member includes a bottom bounded by a side wall also defining one or more corners. An upward extending tongue or extension is defined on each corner of the lower member and each tongue includes an aperture. A tang with an inclined ramp or leading edge is defined on the inner peripheral surface of the wall of the upper member adjacent each corner. A pair of guides on each side of each tang engage and guide the upstanding tongue upon assembly of the housing. A slot is formed in the side wall adjacent the rear corners of the upper housing and a notch is included in the upper end of each upstanding tongue.

The slot and notch may capture and hold a power cord upon assembly of the housing.

The above and other objects and advantages and novel features of the present invention will become apparent from the following detailed description of a preferred embodiment of the invention illustrated in the accompanying drawings.

BRIEF DESCRIPTION OF THE DRAWINGS

FIG. 1 is a perspective view of the upper housing member of the fixture housing of the present invention;

FIG. 2 is a perspective view of the lower housing member of the fixture housing of the present invention.

DESCRIPTION OF THE PREFERRED EMBODIMENT

Figure 3:
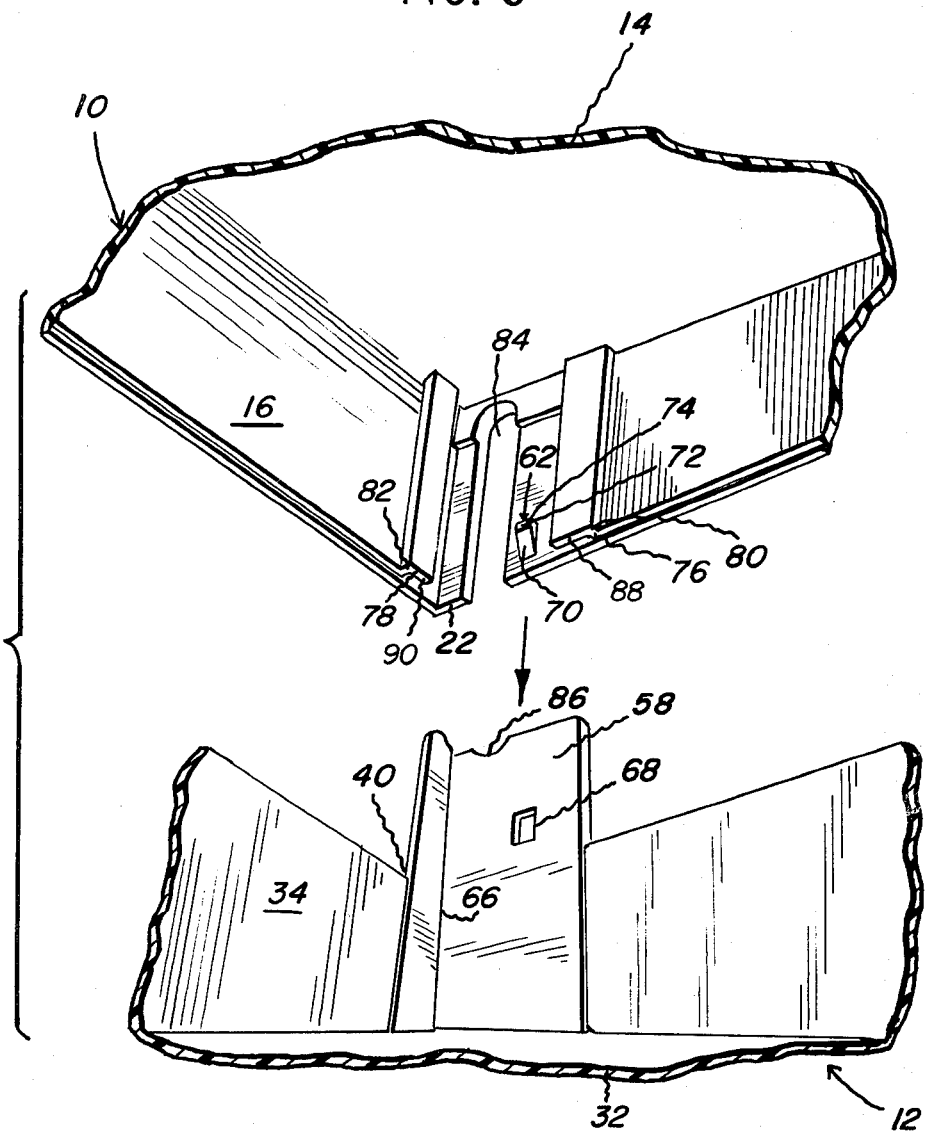
FIG. 3 is a partial, broken and cut-away view of the corners of the upper and lower housing members.

Referring initially to FIGS. 1 and 2, and upper housing member 10 an a lower housing member 12 are illustrated. The upper member 10 and lower member 12 once assembled, define a light fixture housing that contains a light to be used to illuminate a task area. The upper and lower housing members 10 and 12 are fabricated of thermoplastic material that provides some resiliency and are illustrated as rectangular; however, as one skilled in the art will understand, any other suitable configuration would be satisfactory.

The upper housing member 10, includes a top 14 surrounded or bounded on four sides by a sidewall 16. Since the configuration of the upper housing member 10 is rectangular, the sidewall 16 defines four corners 18, 20, 22 and 24. A plurality of slots 26 are fabricated in the side wall 16 and partially into the top 14 to allow circulation of air in order to prevent overheating within the assembled housing. Top 14 also includes knockouts or weakened portions 28 and 30 that may be readily removed to form openings for accomodating headed fasteners (not shown in the drawings) in order to mount the upper housing member 10 on a support structure such as the underside of a shelf.

Lower housing 12 includes a bottom 32 bounded on four sides by a side wall 34 which defines four corners 36, 38, 40 and 42. The bottom 32 includes a concave portion 44 forming a cavity for positioning of a light. The lower housing 12 also includes divider sections designated in their entirety by the reference numeral 46. The dividers 46 separate different compartments which contain various electrical components (not shown). For example, dividers 46 define a compartment 48 within which a coil type ballast may be positioned and compartments 50 and 52 for the positioning of take-up loops of a power cord.

It is desirable that after the upper and lower housing members 10 and 12 have been assembled, they may not be easily disassembled by unauthorized persons. Accordingly, a latch mechanism for latching or locking the upper 10 and lower 12 housing members together is included. The latch mechanism includes upwardly extending tongues or extensions 54, 56, 58 and 60 on the lower housing member 12 and tangs 62 molded on the inner peripheral surface of wall 16 in the upper housing member 10. The tongues 54, 56, 58 and 60 are integrally molded with the side wall 34 and are positioned on the inside surface of the wall 34. Tongues 54, 45, 58 and 60 extend from a lip 64 formed from and slightly inward of the wall 34. Each of the upstanding extensions or tongues 54, 56, 58 and 60 is configured with a right angle bend 66 that provides structural rigidity. An aperture 68 is also included in each tongue or extension 54, 56, 58 and 60 and each tang 62 is received within one of the apertures 68 upon assembly of the upper and lower housing members 10 and 12.

The configuration of the tangs 62 is best illustrated in FIG. 3. Each tang 62 includes and inclined leading edge or ramp 70 that tapers upwardly to a plateau 72 followed by a step or edge 74. In assembly, the housing members 10 and 12 are brought together and the leading edge or inclined ramp 70 engages the top edge of a corresponding tongue 54, 56, 58 and 60 forcing the tongue 54, 56, 58 and 60 inwardly while moving the wall 16 and the tang 62 outwardly. Further movement of the housing members 10 and 12 together causes the engagement of the plateau 72 with the outer peripheral surface of the corresponding tongue 54, 56, 58 and 60. Continued movement slides the plateau 72 downwardly along the outer peripheral surface of the tongue 54, 56, 58 or 60 until reaching the aperture 68, whereupon the tang 62 snaps into the aperture 68. The apertures 68 are rectangular and the top or upper edge of the aperture 68 snaps behind the step 74 locking the upper housing member 10 to the lower housing member 12.

To ensure proper location of the tongues 54, 56, 58 and 60 and the tangs 62 during assembly of the housing members 10 and 12, each tang 62 is bounded by guide members 76 and 78 integrally formed on the interior surface of the wall 16. The guides 76 and 78 are angular in shape and each includes an upstanding leg 80 and 82, respectively, and a leg 88 and 90, respectively, extending parallel to wall 16. During assembly of the upper and lower housing members 10 and 12, each tongue 54, 56, 58 and 60 slides into the guides 76 and 78. The guides 76 and 78 function to align the tongues 54, 56, 58 and 60 with the tangs 62 and, in addition, provide structural rigidity to the latch mechanism.

The latch mechanism of the present invention is not visible upon examination of the outer peripheral surface of the assembled housing thus making unauthorized disassembly of the housing members less likely. The latching of the upper and lower housing members 10 and 12, is not permanent, however, since a serviceman who is aware of the construction of the light fixture may unlatch each of the latch mechanisms at the four corners of the housing by flexing the somewhat resilient walls sufficiently to release the latches. The latch mechanism also requires little internal space and allows assembly without the necessity of tools thereby reducing the assembly cost.

In certain uses it is desirable to pass a power cord into the housing defined by the assembled upper 10 and lower 12 housing members. Accordingly, a slot 84 is formed in the wall 16 and a notch 86 is formed on the upper edge of the each of the tongues 54, 56, 58 and 50. During assembly of the upper 10 and lower 12 housing members, a power cord may be passed through the slot 84 and as one of the tongues 54, 56, 58 and 60 is moved into the corresponding guides 76 and 78, the power cord is frictionally held between the upper end of the slot 84 and the notch 86.

Many modifications and variations of the present invention are possible in light of the above teachings. Thus, it is to be understood that, within the scope of the appended claims, the invention may be practiced other than as specifically described.

I claim:

1. A light fixture housing, comprising:

an upper housing including a top and an upper housing side wall, said upper housing side wall defining at least one upper corner, a tang on the inner peripheral surface of said upper housing side wall adjacent said upper corner, a bottom housing including a bottom and a bottom housing side wall, said bottom housing side wall defining at least one bottom corner, a flange on said bottom corner of said bottom housing extending above said bottom housing side wall, and an apperture in said flange for cooperative engagement with said tang on said inner peripheral surface of said upper housing side wall, thereby to securely hold together said upper housing and said lower housing.

2. The light fixture housing set forth in claim 1 further comprising a slot in said side wall of said upper housing adjacent said one corner.

3. The light fixture housing set forth in claim 2 further comprising a notch in said flange.

4. The light fixture housing set forth in claim 1 further comprising at least one guide for said flange on the inner peripheral surface of said upper housing side wall adjacent said one upper corner of said upper housing.

5. The light fixture housing set forth in claim 1 wherein said tang includes a tapered lead ramp.

6. A hidden latch mechanism for a light fixture housing wherein said housing includes upper and lower members, said upper member including a top with a side wall bounding said top, said lower member including a bottom, said latch mechanism comprising:

at least one tang member on the inner peripheral surface of said side wall, and an upstanding tongue on said lower member, said tongue including an aperture for cooperative engagement with said tang on said inner peripheral surface of said side wall, thereby to securely hold together said lower housing and said lower housing.

7. The hidden latch mechanism claimed in claim 6 further comprising at least one guide on the inner peripheral surface of said side wall.

8. The hidden latch mechanism claimed in claim 6 wherein said tang member includes a tapered lead ramp.

9. The hidden latch mechanism claimed in claim 6 wherein said tongue includes a 90-degree bend.

10. The hidden mechanism claimed in claim 6 further comprising a slot in said side wall.

11. The hidden latch mechanism claimed in claim 6 further comprising a notch in an upper end of said tongue.

12. A light fixture housing, comprising:

upper and lower housing members, said upper housing member includes a top, a side wall surrounding said top, a tang with an inclined leading ramp on the inner peripheral surface of said side wall, at least one guide on said inner peripheral surface of said side wall adjacent said tang, said lower housing member includes a bottom, a side wall surrounding said bottom and engageable with said upper housing member side wall upon assembly of said light fixture housing, at least one extension inside of and extending above said lower housing member side wall, said extension including an aperture for cooperative engagement with said tang on said peripheral surface of said upper housing member side wall, thereby to securely hold together said upper housing member and said lower housing member.

13. The light fixture housing set forth in claim 12 further comprising a slot in said upper housing side wall between said tang and said guide.

14. The light fixture housing set forth in claim 12 further comprising a notch in an upper end of said extension.

15. The light fixture housing set forth in claim 12 wherein said extension is configured with a 90-degree bend.

* * * * *